US005521344A

United States Patent [19]

De Leo

[11] Patent Number: 5,521,344

[45] Date of Patent: May 28, 1996

[54] CIRCUIT BREAKER LOCK-OUT BLOCK

[76] Inventor: John De Leo, 107 Sun Valley Dr., Southington, Conn. 06489

[21] Appl. No.: 372,502

[22] Filed: Jan. 13, 1995

[51] Int. Cl.[6] ..... H01H 9/28

[52] U.S. Cl. ..... 200/43.140; 200/43.160; 200/43.170

[58] Field of Search ..... 200/43.14, 43.15, 200/43.16, 43.19, 43.01, 43.11, 43.21, 333

[56] References Cited

U.S. PATENT DOCUMENTS

| | | | |
|---|---|---|---|
| 4,467,152 | 8/1989 | Gordy | 200/43.15 |
| 4,978,816 | 12/1990 | Castonguay et al. | 200/43.14 |
| 5,079,390 | 1/1992 | Costanzo et al. | 200/43.14 |
| 5,122,624 | 6/1992 | Benda | 200/43.14 |
| 5,256,838 | 10/1993 | Benda | 200/43.15 |
| 5,310,969 | 5/1995 | Turek et al. | 200/43.14 |

*Primary Examiner*—David J. Walczak

[57] ABSTRACT

A circuit breaker handle locking block is arranged on a top of circuit breaker with the circuit breaker operating handle extending through a clearance slot in the locking block. The sides of the circuit breaker handle slot are ramped to conform to the angle defined between the circuit breaker handle and the top of the circuit breaker when the circuit breaker handle is in the OFF position. The circuit breaker handle extends through the clearance slot in a nearly press-fit relation so that the circuit breaker handle is restrained from moving to the ON position until the locking block is removed.

6 Claims, 3 Drawing Sheets

CIRCUIT BREAKER LOCK-OUT BLOCK

BACKGROUND OF THE INVENTION

Both residential and industrial circuit breakers and switches are often locked in their OFF conditions by arranging some sort of locking device on the operating handles to prevent the handles from displacement for both economic as well as safety considerations. In vacant apartments, the circuit breakers are locked in their OFF conditions to prevent unauthorized use of electric utility power. Industrial circuit breakers are locked in their OFF positions when work is performed on remote electrical equipment to prevent inadvertent energization of the equipment with the possibility of damage to the repairman.

State-of-art locking devices are often quite complex and usually quite expensive. The circuit breakers are customized to receive the locking devices and generally require holes to be drilled or formed in the top surface to accommodate the locking devices. With the increased demand for such locking devices in both apartment buildings and industrial facilities, it would be economically-advantageous to provide a simple device that is readily installed onto the circuit breaker operating handles without requiring drilling holes in the top of the circuit breakers or any other change to the circuit breakers per se.

One purpose of the invention is to describe a simple and economic circuit breaker operating handle locking device in the form of a lockout block that readily accommodates existing circuit breaker operating handles without requiring any changes to the circuit breakers.

SUMMARY OF THE INVENTION

A circuit breaker operating handle lockout block in the form of a plastic body having an angled slot defined between the top and bottom of the block. The ramped sides of the slot are arranged at the same angle as the circuit breaker operating handle in the OFF position.

DESCRIPTION OF THE PREFERRED EMBODIMENT

Figure 1:
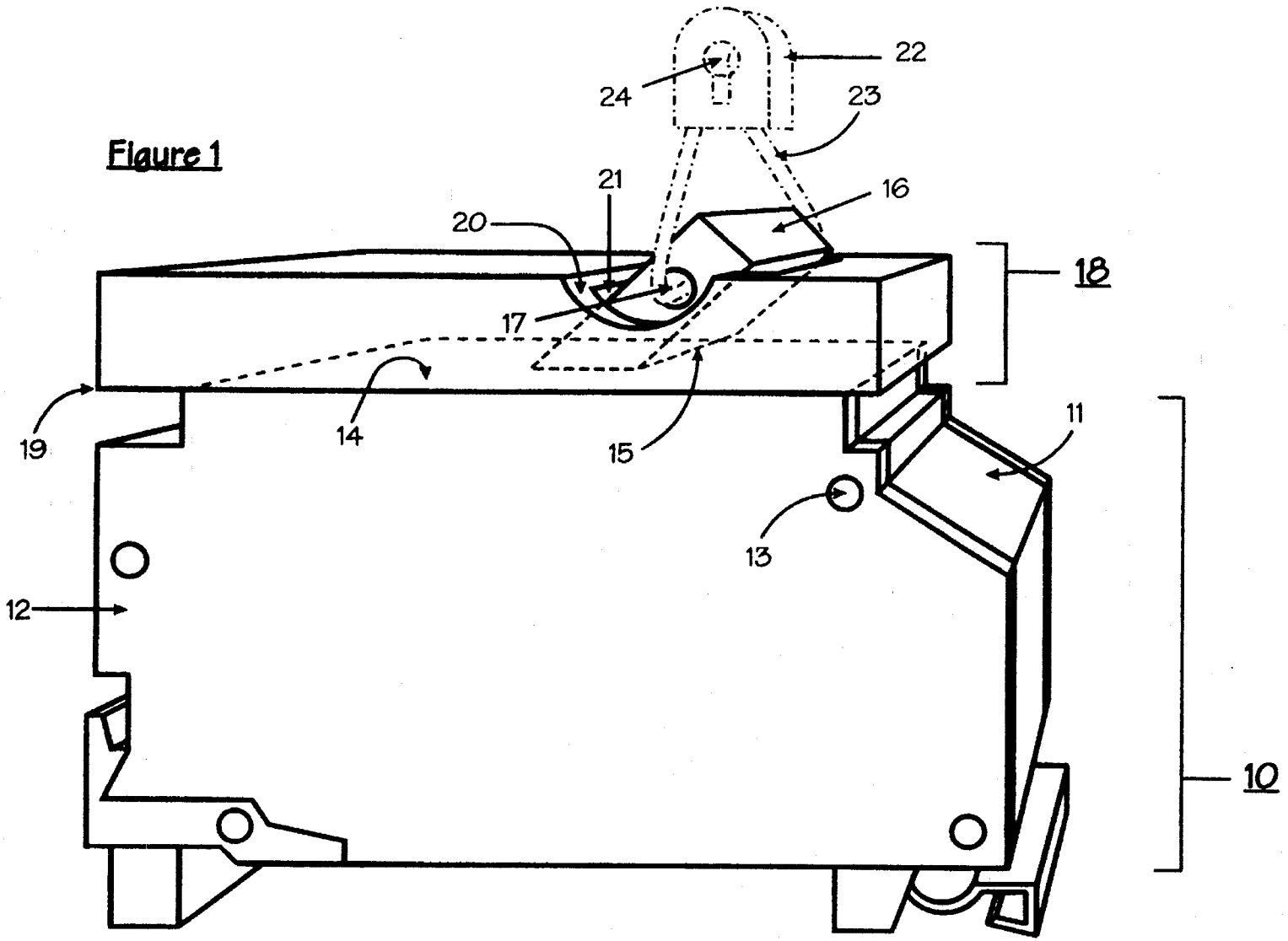
FIG. 1 is a front perspective view of a residential circuit breaker interlocked with the lockout block according to the invention.

A residential circuit breaker 10 is shown in FIG. 1 of the type consisting of case 11 to which a cover 12 is attached by means of rivets 13. Although the description is for a circuit breaker herein, the invention also finds application with electric switches as well. An operating handle 16 extends through a slot 15 in the circuit breaker top 14 for turning the circuit breaker between its ON and OFF conditions. In accordance with the invention, a lockout block 18 formed of either a thermoset or thermoplastic material, such as Lucite, which is a trademark of Dupont for a transparent thermoplastic is shown. The transparent properties allows an operator to view the ON and OFF indicia on the circuit breaker top when the lockout block is fastened in position by means of the padlock 22 as indicated in phantom. With the circuit breaker operating handle 16 extending through the rectangular slot 21 in the lockout block, the aperture 17 in the operating handle 16 is accessible by means of the arcuate slot 20 formed in the top 25 of the lockout block. With the arms 23 of padlock 22 extending through the aperture 17 in the operating handle 16, the lockout block 18 cannot be removed from the circuit breaker except by means insertion of a key within the keyhole 24 without obvious indication of damage to the padlock and/or the operating handle.

Figure 2:
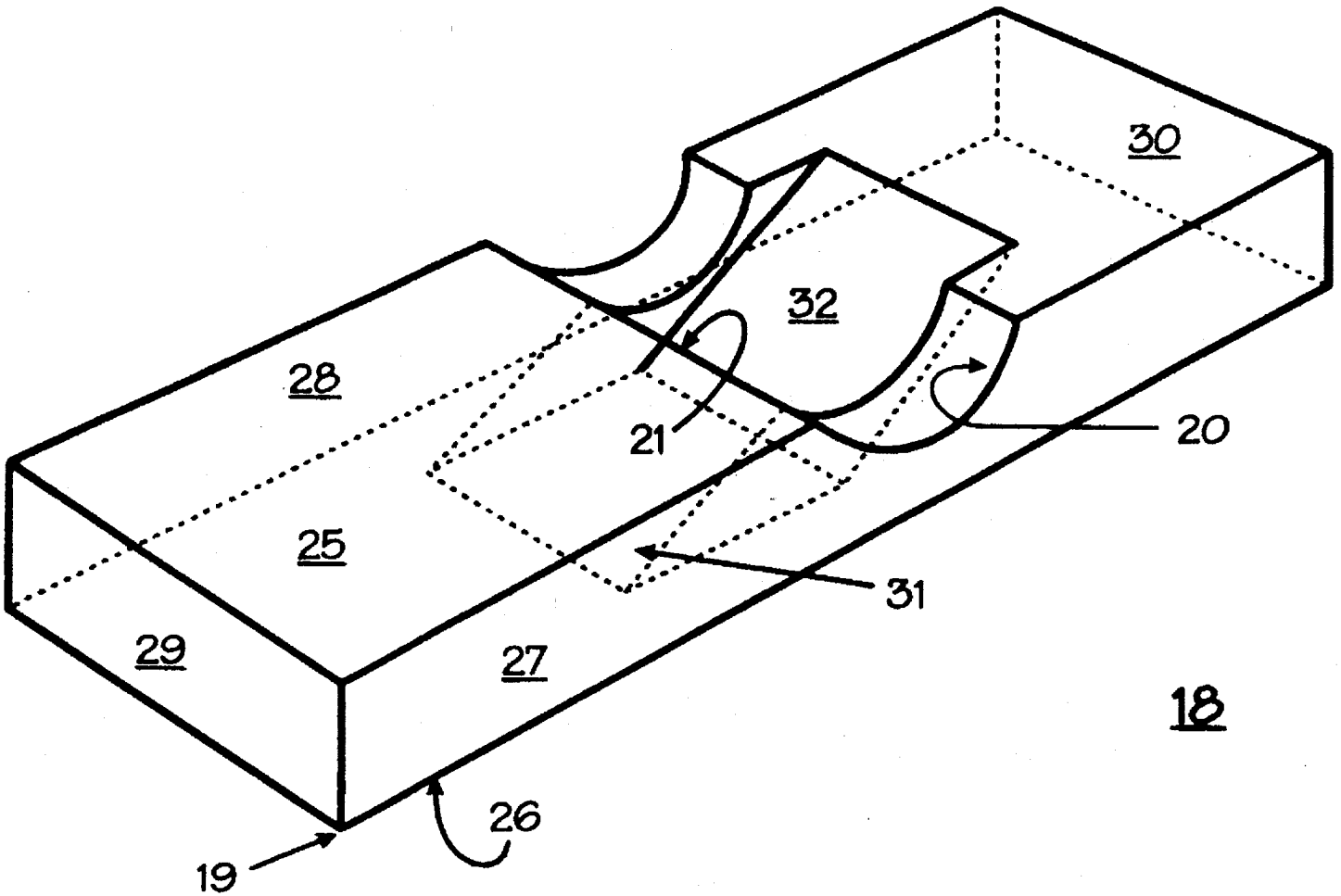
FIG. 2 is an enlarged top perspective view of the lockout block of FIG. 1.

The configuration of the lockout block 18 is best seen by now referring to FIG. 2 wherein the rectangular solid 19 is depicted as consisting of a top 25 and a bottom 26 joined by opposing end walls 29,30 and opposing side walls 27,28. The arcuate slot 20 extends across the top 25 and the rectangular slot 21 extends from the top 25 to the bottom 26. The rectangular slot 21 is defined by means of front ramp 31 and a rear ramp 32.

Figure 3:
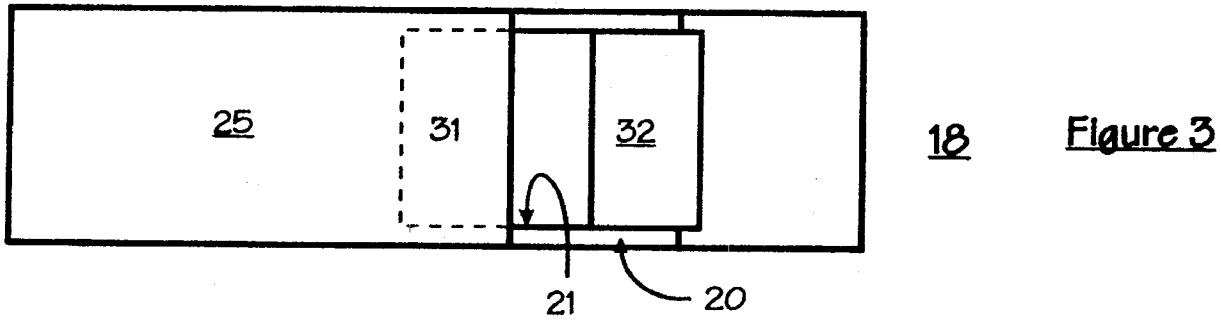
FIG. 3 is a top plan view of the lockout block of FIG. 1.
Figure 4:
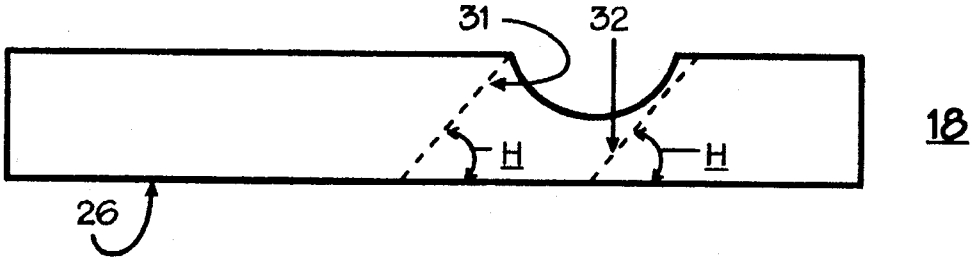
FIG. 4 is a side view of the lockout block of FIG. 1.
Figure 5:
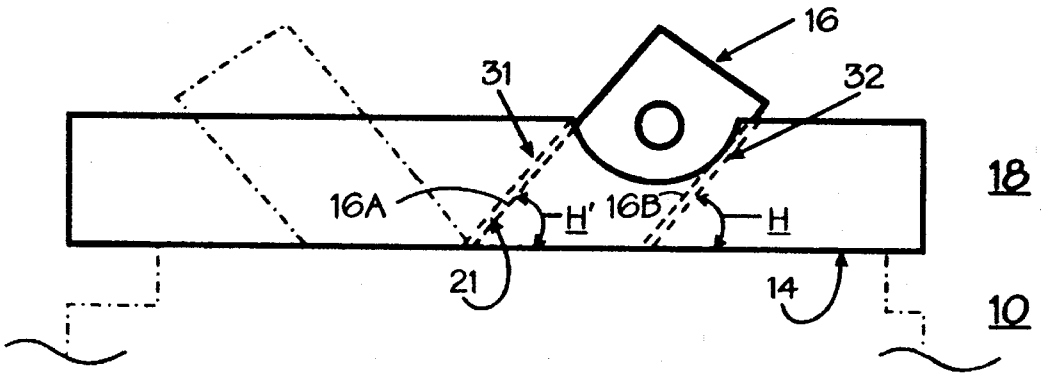
FIG. 5 is a side view of a circuit breaker containing the lockout block of FIG. 1.

The lockout block 18 is shown in FIG. 3 to detail the front and rear ramps 31,32 defining the rectangular slot 21 and the arcuate slot 20 extending across the top 25. As shown in FIGS. 4 and 5, the front and rear ramps 31,32 are both shown to extend at an angle H relative to the bottom 26. The angle H exactly corresponds to the same angle H' that the circuit breaker operating handle 16 on the circuit breaker 10 makes with the top 14 of the circuit breaker when the operating handle is in the OFF position. The circuit breaker operating handle is depicted within the rectangular slot 21 formed in the lockout block 18 with a slight clearance between the front 16A of the operating handle 16 and the front ramp 31 and a slight clearance between the rear 16B of the operating handle and the rear ramp 31. This positively prevents the operating handle from rotating since the operating handle is unable to move in either a forward or reverse direction and hence cannot over-center as required to turn the circuit breaker from the OFF to ON conditions. In the event the circuit breaker is required to be locked in the ON condition as indicated in phantom, the locking block is removed and reversed to position the operating handle within the rectangular slot 21 facing the opposite direction from that shown in FIG. 5.

An inexpensive lockout block has herein been described for use with both electric switches and electric circuit breakers to lock the switches and circuit breakers in either an ON or OFF condition with no modification to the switches or circuit breakers per se.

I claim:

1. An interlock device adapted to be positioned adjacent an upper surface of an electric circuit interruption device having a rocking operating handle which is movable between two opposed end positions comprising:

a rectangular block defining top and bottom opposing surfaces;

a slot extending through said block and extending from said top surface to said bottom surface, said slot adapted for receiving said operating handle of said interruption device when said bottom surface of said block is positioned adjacent said top surface of said interruption device, said slot having a first ramped sidewall extending from said bottom surface of said block to said top surface of said block and disposed at an angle to said bottom surface which is substantially equal to an angle defined between said operating handle and said top surface of said interruption device when said operating handle is in an end position whereby said operating handle is adapted to abut said first ramped side wall when said operating handle is in said end position such that said operating handle is restrained from movement from said end position; and a groove formed on said top surface of said block and extending from one side edge of said top surface of said block, over said slot and terminating at an opposite side edge of said top surface of said block, said groove adapted to provide access to an opening in said operating handle.

2. The interlock arrangement of claim 1 wherein said block comprises an electrically-insulative material.

3. The interlock arrangement of claim 2 wherein said block comprises plastic.

4. The interlock arrangement of claim 3 wherein said plastic is transparent for providing visual access to ON and OFF indicia on said top surface of said interruption device.

5. The interlock arrangement of claim 1 including a second ramped sidewall in said slot opposite from said first ramped sidewall defining a clearance space between said first and second ramped sidewalls, said operating handle extending within said clearance space.

6. The interlock arrangement of claim 1 wherein said operating handle includes an aperture at one end, said aperture being arranged for receiving a padlock hasp for preventing removal of said block from said interruption device.

* * * * *